US005735504A

United States Patent [19]

Walters

[11] Patent Number: 5,735,504

[45] Date of Patent: Apr. 7, 1998

[54] VARIABLE OVERPRESSURE RELIEF VALVE

[76] Inventor: William D. Walters, 2230 Biscay Ct., Byron, Calif. 94514

[21] Appl. No.: 719,265

[22] Filed: Sep. 24, 1996

[51] Int. Cl.[6] ..... F16K 15/00

[52] U.S. Cl. ..... 251/83; 137/540

[58] Field of Search ..... 137/505.11; 251/82, 251/83, 540, 542, 543.21

[56] References Cited

U.S. PATENT DOCUMENTS

| | | | |
|---|---|---|---|
| 1,712,298 | 5/1929 | Ford | 251/83 |
| 2,861,569 | 11/1958 | Emerson | 251/83 |
| 3,866,253 | 2/1975 | Sinks et al. | 128/142 |
| 4,227,521 | 10/1980 | Hart et al. | 128/202.14 |
| 4,379,656 | 4/1983 | Darling | 137/505.11 |
| 5,505,559 | 4/1996 | Hermansen | 137/505.11 |

FOREIGN PATENT DOCUMENTS

| | | | |
|---|---|---|---|
| 576519 | 1/1924 | France | 251/83 |
| 959871 | 3/1957 | Germany | 251/83 |

OTHER PUBLICATIONS

Catalog sheet "1995 Alliance Integrated Inflator System"–Items numbered 1–14 constitute an overpressure relief valve for a scuba apparatus.

Catalog sheet "1989 Oceanic Inflator System"–Item #84816 discloses a buoyancy compensator overpressure valve assembly.

*Primary Examiner*—Denise L. Ferensic
*Assistant Examiner*—Ramyar Farid
*Attorney, Agent, or Firm*—Bruce & McCoy

[57] ABSTRACT

A variable overpressure relief valve for a buoyancy compensator including an open hole base member for securement to a buoyancy compensator and a pair of spring biased floating disks in the base member sealing the hole and biased apart and held in place by a vented cover secured to the base member and having an adjustment button for changing the spring bias separating the floating disks.

5 Claims, 1 Drawing Sheet

VARIABLE OVERPRESSURE RELIEF VALVE

BACKGROUND OF THE INVENTION

1. Field of the Invention

The present invention relates to overpressure relief valves and, more particularly, to a variable overpressure relief valve for buoyancy compensators used for scuba diving. A buoyancy compensator is partially inflated to compensate for the weight of the equipment a diver is carrying. It is usually connected to the scuba air tank so that a diver can actuate an air flow control valve and inflate the compensator. Usually the diver increases the inflation of the buoyancy compensator a small amount when he wants to go to the surface. In order to prevent overinflation of the compensator during the diver's ascent, due to the decreasing water pressure causing too rapid a rise of the diver, or possible explosive rupture of the buoyancy compensator, a relief valve is integrated into the fabric of the compensator to permit the release of overpressure.

2. Description of the Prior Art

Standard relief valves for a buoyancy compensator (sometimes hereafter referred to as a "B.C.") include a base member which is secured to the external surface of the B.C. and provides basically an air vent passageway in the air containment chamber of the B.C. The air escape passageway vents the internal air cavity to the ambient medium which is usually water but can be air. The base member has a flange which is usually glued to the rubberized fabric material of the B.C. The base member permits a cap to be secured to the base member generally by a threaded engagement between the two. The standard valve includes a floating disk which covers the hole forming the passageway in the base member. The disk is spring biased by means of a compression spring disposed between the cap and the floating disk which keeps the disk pressed on the hole of the base member keeping it sealed shut. A pull cord is usually secured to the center of the disk and extends through the coil spring and out through the cap whereby a diver can grab the pull cord and put tension on it to pull the disk away from its sealing position on the hole in the base member. As a result, air can be released from the B.C. a desired amount and then the pull cord released to reseal the hole in the base member and stop the venting of air from the B.C.

A need exists in the art of overpressure relief valves to make the action automatic, not requiring the attention and operation of the valve by the diver which usually results in the inexact release of air which in most cases is an insufficient release of pressure. Correction usually requires successive pulls on the cord. If too long of a pull occurs, causing the release of too much air, the diver will sink, and that usually happens just as the diver is approaching the exact release of air he intended to achieve the equilibrium he desires. Therefore, there is a need for a variable overpressure relief valve which works automatically and can be preset which is the design purpose and resulting effect of the present invention.

SUMMARY OF THE INVENTION

The present invention is a variable overpressure relief valve for scuba diving buoyancy compensators. It includes a cylindrical base member having a lateral flange for air sealed securement to the material portion of a B.C. forming the inflatable air compartment thereof. The base member has a central air passageway for communication with the air compartment, and the base member is formed for releasably engaging a cap. A first or inner floating disk is disposed internally of the cylindrical cavity of the base member and is formed for sealing the air passageway. The diameter of the disk is smaller than the internal diameter of the cylindrical cavity in the base member whereby air vented from the B.C. air compartment through the air passageway can flow around the edges of the disk and out of the base member. A second or outer floating disk is secured to the first floating disk by a means which prevents separation of the disks beyond a predetermined adjustable limit and positions the second disk in a predetermined relation with respect to the first floating disk. A spring means is disposed between the floating disks and is biased to urge the disks apart. A vented cap is releasably engaged to the base member permitting air vented around the edges of the first floating disk to leave the interior of the base member. An adjustment button is reciprocably engaged to the cap and projects therethrough whereby the button can move adjustably in and out with respect to the interior of the base member. The adjustment button is interconnected to the second floating disk whereby movement of the button in or out with respect to the base member increases or decreases the spring pressure separating the floating disks depending upon whether the button moves inward or outward with respect to the vented cap. Means are provided for external control of the reciprocating movement of the button.

OBJECTS OF THE INVENTION

It is therefore an important object of the present invention to provide an improved variable overpressure relief valve for buoyancy compensators.

It is another object of the present invention to provide an adjustable overpressure relief valve which operates automatically.

It is a further object of the present invention to provide a variable pressure relief valve which can be operated by the diver wearing the B.C.

Other objects and advantages of the present invention will become apparent when the apparatus of the present invention is considered in conjunction with the accompanying drawings.

DESCRIPTION OF THE PREFERRED EMBODIMENT

Figure 1:
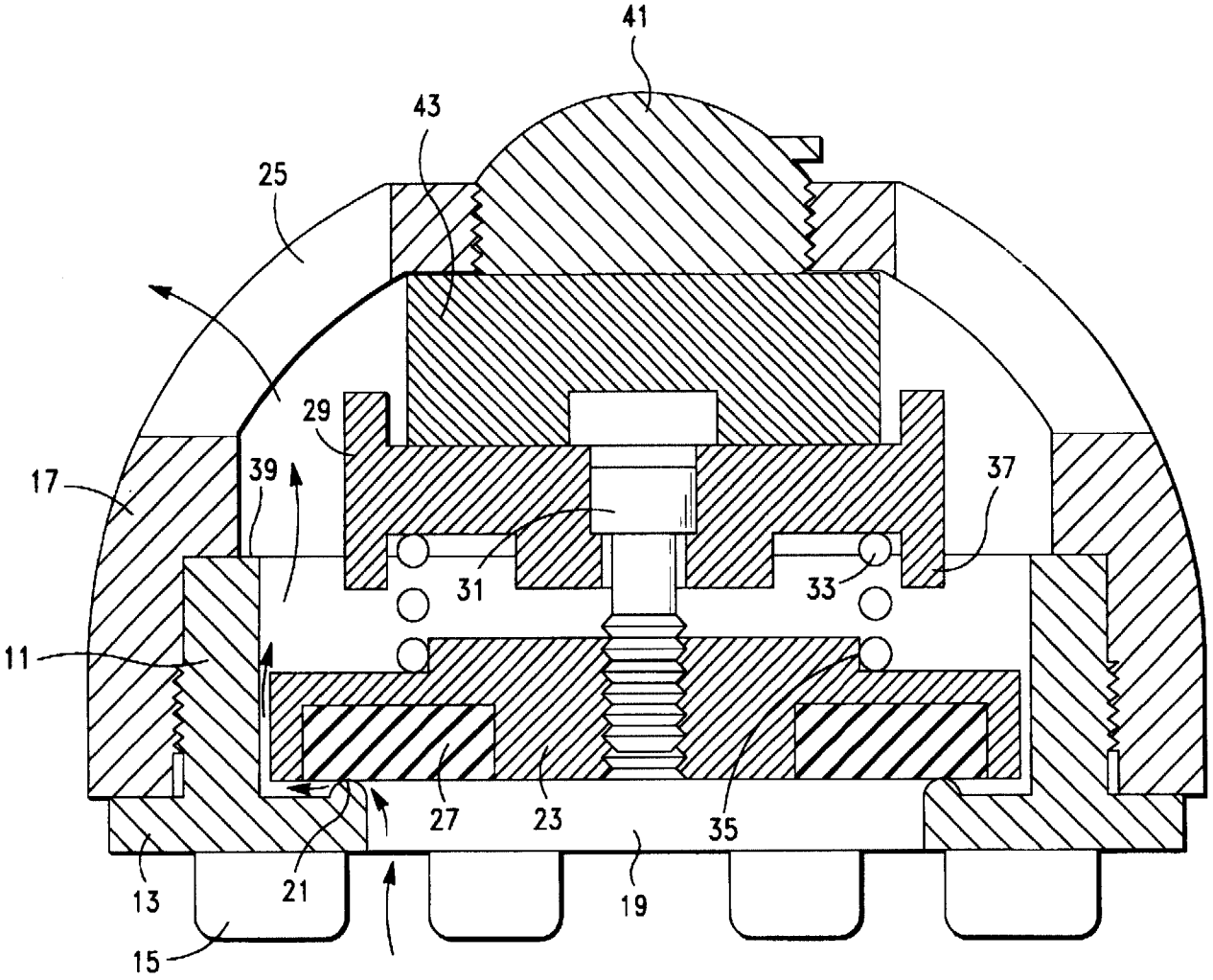
FIG. 1 is a side elevation in cross-section showing the variable overpressure relief valve of the present invention.

Reference is made to the drawings for a description of the preferred embodiment of the present invention wherein like reference numbers represent like elements on corresponding views.

FIG. 1 shows the variable overpressure relief valve of the present invention in cross section. There shown is a cylindrical base member 11 having a lateral flange 13 for attachment to the external surface of a buoyancy compensator. The flange is usually glued to the material portion of the B.C. which forms the inflatable air compartment. It is usually located on the front of the B.C. high up where a diver's hand would naturally come to rest.

Projecting locating studs 15 center the base member 11 in the hole formed in the B.C. fabric for the purpose of gluing the flat underside of the flange 13 of the base member to the fabric of the B.C. The lateral flange formed on the base member provides a wider surface area for the purpose of gluing the base member to the B.C. rubberized fabric. The flange top surface also provides a stop surface for the cap or cover 17 when it is threadably secured to the base member. The stop surface prevents over-tightening, and provides a positioning surface for the cap to locate against. The stop function of the flange also prevents over tightening of the cap from pushing the base member away from its glued attachment to the B.C. fabric.

The base member 11 has a central air passageway 19 for communication with the inner air compartment or chamber of the buoyancy compensator. This communication passageway is surrounded by a slight flange or lip 21 which permits a sharper sealing edge or sealing surface to be projected outward of the base member for sealing with the closing element or stopper 23. The base member is provided with means for releasably engaging the cap or cover 17. In the preferred embodiment, threads are formed on the external cylindrical surface of the base member to engage internal threads formed in the cap. Other cap engagement means would work equally satisfactorily but a threaded engagement is the simplest and least expensive to manufacture because it can be molded into the two engaging elements.

A first or inner floating disk 23 is disposed internally of the cylindrical cavity of the base member 11 and is formed for sealing the air passageway 19. The diameter of the disk is smaller than the internal diameter of the cylindrical cavity of the base member so that air vented from the air compartment of the buoyancy compensator through the air passageway of the base member, flows up and over the flange or lip 21 and then outward around the edges of the floating disk. The air then flows out of the base member and into the cap where it in turn vents out through the holes 25 in the cap into the surrounding water or air. The term "floating" as used herein to describe the disks and an interconnecting bolt means that the floating elements are not interconnected to the surrounding structure that they are contained in.

The first floating disk 23 includes a pliant sealing washer 27 which is cylindrical in configuration, in the form of a ring, and it is captured in a recess in the floating disk and seals against the adjacent outward projecting lip 21 of the base member 11 surrounding the air passage 19. Other configurations than a round disk in a cylindrical cavity, such as square, oval, and polygonal shapes, could be utilized for the valve elements, but a circular configuration is the simplest to manufacture.

A second or outer floating disk 29 is interconnected to the first floating disk 23 by a means which permits reciprocating movement of the disks with respect to each other but prevents the separation of the two disks beyond a predetermined adjustable limit and positions and maintains the disks in a predetermined relation with respect to each other. In the preferred embodiment of the invention, this is accomplished by a floating bolt 31 which projects through and is captured by the second floating disk and is threadably engaged to the first floating disk. This arrangement permits the bolt to be adjusted to set a predetermined adjustable space between the disks. The bolt head is disposed in a recessed chamber formed in the second disk whereby the bolt can reciprocate freely therein but is confined in its movement thereby. It is obvious that the bolt can be inverted and screwed into the second floating disk and captured by the first floating disk to perform in the same manner.

A spring means 33 is disposed between the floating disks and is biased to urge the disks apart. In the preferred embodiment, this bias is effected by a coil spring which is centered on the inner floating disk 23 by means of a central projecting cylindrical portion 35 formed on the disk which the spring member is stretched around for positioning. The spring member bears against an inner surface of the outer floating disk 29 and is captured by a cylindrical flange 37 which projects inward or downward towards the first floating disk.

The vented cap 17 is threadably engaged to the base member. The bottom edge of the vented cover locates against the top surface of the flange 13 of the base member as well as to the internal top edge 39 of the base member. The cap could be a plug secured internally of the base member, but a cap construction is simpler and provides a plurality of locating surfaces.

An adjustment button is reciprocably engaged to the cap 17 and projects therethrough to permit the button to move adjustably in and out with respect to the interior of the base member 11. In the preferred embodiment, this is accomplished by means of an internally threaded cylindrical surface in the cap which engages the threaded external cylindrical surface of the button.

The adjustment button 41 is interconnected to the second floating disk 29 whereby movement of the button in or out with respect to the base member moves the inner disk in the same manner. The button can be provided with a slit for a screwdriver or with a knob-type surface for simple grasping and turning by the diver with his fingers. Turning of the adjustment button moves it in or out with respect to the vented cover 17. A pull cord can be inserted through the center of the button and connected to the central bolt 31 for hand or manual actuation of the inner floating disk 23 to vent the buoyancy compensator.

A spacer 43 is disposed between the adjustment button 41 and the second floating disk 29 whereby rotation of the adjustment button increases or decreases the spring pressure separating the floating disks depending upon whether the button moves inward to compress the spring 35 or outward with respect to the vented cover 17 to release the pressure on the spring and thereby releasing the pressure holding the first or inner floating disk 23 against the lips 21 of the air passageway 19. The spacer element defines an extended portion of the chamber formed in the second floating disk to accommodate reciprocating movement of the floating bolt 31 when movement of the first floating disk forces the bolt to project beyond the chamber formed in the second disk.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. A variable overpressure relief valve for a buoyancy compensator comprising a cylindrical base member having a lateral flange for air sealed securement to a material portion of a buoyancy compensator forming an inflatable air compartment thereof, said base member having a central air passageway for communication with said air compartment, said base member formed for releasably engaging a cap, an inner floating first disk disposed internally of a cylindrical cavity of said base member and formed for sealing said air passageway, the diameter of said disk being smaller than the internal diameter of said cylindrical cavity of said base member whereby air vented from said buoyancy compensator air compartment through said air passageway can flow around the edges of said disk and out of said base member, an outer floating second disk interconnected to said first floating disk by a floating bolt captured by and projecting through said second floating disk and threadably engaging said first floating disk, the head of said bolt being disposed in a recessed chamber formed in said second disk whereby said bolt can reciprocate freely therein but is confined in its movement, thereby said bolt interconnection between said disks permitting reciprocating movement of said disks with respect to each other but preventing separation of said disks beyond a predetermined adjustable limit and positioning said second disk in a predetermined relation with respect to said first floating disk, spring means disposed between said floating disks and biased to urge said disks apart, a vented cap releasably engaged to said base member permitting air vented around the edges of said first floating disk to exit the interior of said base member, an adjustment button reciprocally engaged to said cap and projecting therethrough whereby said button can move adjustably in and out with respect to the interior of said base member, said adjustment button being interconnected to said second floating disk whereby movement of said button in or out with respect to said base member increases or decreases the spring pressure separating the floating disks depending upon whether the button moves inward or outward with respect to said vented cap, and means for external control of the reciprocatable movement of said button.

2. The variable overpressure relief valve of claim 1 including a spacer element disposed between said adjustment button and said second floating disk, said spacer element defining an extended portion of said chamber formed in said second floating disk to accommodate reciprocating movement of said bolt when movement of said first disk forces said bolt to project beyond the chamber formed in said second disk.

3. The variable overpressure relief valve of claim 1 wherein said adjustment button is threadably engaged to the center of said cap whereby rotation of said button in one direction or the other moves the button in and out with respect to said base member.

4. The variable overpressure relief valve of claim 1 wherein said first floating disk includes a pliant sealing washer captured therein which seals against the adjacent surfaces of the base member.

5. A variable overpressure relief valve for a buoyancy compensator comprising a cylindrical base member having a lateral flange for air sealed securement to a material portion of a buoyancy compensator forming an inflatable air compartment thereof, said base member having a central air passageway for communication with said air compartment, said base member formed for releasably engaging a cap, an inner floating first disk disposed internally of a cylindrical cavity of said base member and formed for sealing said air passageway, the diameter of said disk being smaller than the internal diameter of said cylindrical cavity of said base member whereby air vented from said buoyancy compensator air compartment through said air passageway can flow around the edges of said disk and out of said base member, said disk including a pliant sealing washer captured therein which seals against the adjacent surfaces of the base member, an outer floating second disk interconnected to said first floating disk by a floating bolt captured by and projecting through said second floating disk and threadably engaging said first floating disk, the head of said bolt being disposed in a recessed chamber formed in said second disk whereby said bolt can reciprocate freely therein but is confined in its movement, thereby, said bolt interconnection between said disks permitting reciprocating movement of said disks with respect to each other but preventing separation of said disks beyond a predetermined adjustable limit and positioning said second disk in a predetermined relation with respect to said first floating disk, spring means disposed between said floating disks and biased to urge said disks apart, a vented cap releasably engaged to said base member permitting air vented around the edges of said first floating disk to exit the interior of said base member, an adjustment button threadably engaged to said cap and projecting therethrough whereby said button can move adjustably in and out with respect to the interior of said base member, said adjustment button being interconnected to said second floating disk whereby movement of said button in or out with respect to said base member increases or decreases the spring pressure separating the floating disks depending upon whether the button moves inward or outward with respect to said vented cap, and means for external control of the reciprocatable movement of said button.

* * * * *